United States Patent [19]

Stog

[11] 4,044,887

[45] Aug. 30, 1977

[54] APPARATUS FOR REMOVING COKE FROM AN INCLINED WHARF

[75] Inventor: Wilhelm Stog, Waltrop, Germany

[73] Assignee: WSW Stahl- und Wasserbau GmbH Selm, Waltrop, Germany

[21] Appl. No.: 708,874

[22] Filed: July 26, 1976

[30] Foreign Application Priority Data

July 25, 1975 Germany ..... 2533394

[51] Int. Cl.[2] ..... B65G 37/00; G01F 11/10

[52] U.S. Cl. ..... 198/526; 198/544; 222/368

[58] Field of Search ..... 222/368; 198/525, 526, 198/527, 544

[56] References Cited

U.S. PATENT DOCUMENTS

| | | | |
|---|---|---|---|
| 1,014,280 | 1/1912 | Ball | 222/368 |
| 3,830,357 | 8/1974 | West et al. | 222/368 |

FOREIGN PATENT DOCUMENTS

| | | | |
|---|---|---|---|
| 420,826 | 10/1925 | Germany | 222/368 |
| 588,260 | 11/1933 | Germany | 222/368 |
| 182,136 | 9/1923 | United Kingdom | 222/368 |
| 817,328 | 7/1959 | United Kingdom | 222/368 |

*Primary Examiner*—Robert B. Reeves
*Assistant Examiner*—Hadd Lane
*Attorney, Agent, or Firm*—Walter Becker

[57] ABSTRACT

An apparatus for transferring coke in measured quantities from an inclined wharf on to a horizontal conveyor, which comprises a roll being provided with a circumferential shell enclosing a chamber with a peripheral aperture. The peripheral apeture extends straight or helically over the entire length of the roll. The helical peripheral aperture extends only over a zone of about 270°.

7 Claims, 5 Drawing Figures

FIG.1
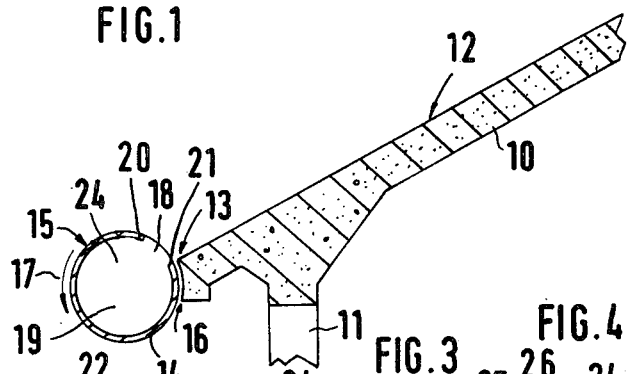
FIG.5
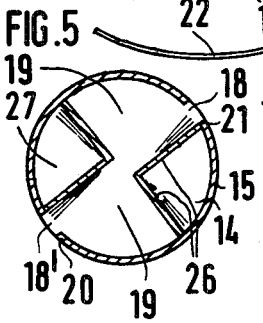
FIG.3
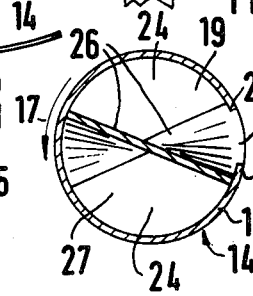
FIG.4
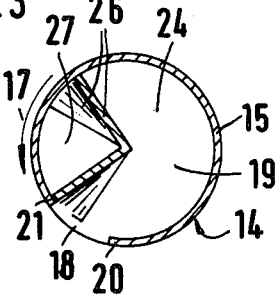
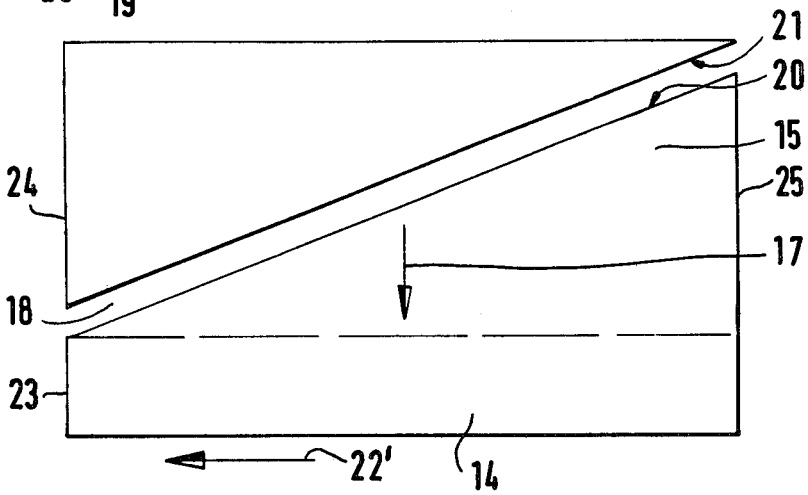
FIG.2

APPARATUS FOR REMOVING COKE FROM AN INCLINED WHARF

BACKGROUND OF THE INVENTION

In apparatus for removing coke from an inclined wharf using a roll disposed at the discharge end of the wharf for transferring the coke on to a horizontal conveyor which is provided parallel to the wharf at the discharge end it is known that the wharf has a row of retaining grates which are disposed at the discharge end above the wharf, which are individually opened in order to allow a desired amount of coke to slide at a determined point on to the conveyor belt. In order to ensure a uniform transfer it is known to arrange at the free end of the wharf a roll which rotates continuously and thus directs the coke on to the conveyor belt. In addition to the use of a roll having a smooth, closed surface, it is also known to provide on the surface of the roll chambers which are formed by radial ribs. The chambers can even extend as far as the shaft so that a bucket wheel results. The chambers in the form of segments or sectors are completely open externally so that the roll equalizes the coke flow approximately in the manner of an impeller, said flow being released by the retaining grates. The constructional expenditure for these retaining grates is considerable, in particular if the labour force for operating the retaining grates is replaced by automatic control systems.

SUMMARY OF THE INVENTION

This invention relates to an apparatus comprising a rotatably mounted roll which is provided with a circumferential shell enclosing a chamber within the cavity of said hollow roll, said chamber having a peripheral aperture provided in said circumferential shell and extending longitudinally over the entire length of said roll but only over a small portion of the periphery of said chamber. It is the object of the invention to make possible a uniform and controllable removal of coke from the wharf without the necessity of providing retaining grates.

The apparatus in accordance with the invention brings the advantage that the closed circumferential surface acts in the manner of the retaining grates, the peripheral aperture allowing the removal of a certain quantity of coke from the wharf. The hollow roll is advantageously driven continuously, its peripheral velocity being matched to the feed rate of the conveyor belt.

Advantageously the peripheral aperture extends helically over the periphery of the roll so that coke is successively discharged from the wharf at specific points thereon. The coke is then poured after a given period of time on to the conveyor belt. In conformity with the path of the helical peripheral aperture, the discharge points shifts over the entire length of the roll and of the coke wharf, in which case the conveyor belt carries out a relative movement so that from the outset in feed direction the coke deposited on the conveyor belt is immediately conveyed away from the region of the roll. In this way it is additionally possible to control the layer depth of the coke on the conveyor belt. At the same time it is possible to achieve an equalization of the loading of the conveyor belt.

The helical peripheral aperture, which extends approximately over an arc of 10 to 20 percent of the entire periphery of the chamber, extends advantageously only over a zone of about 270°, so that the circumferential surface of the shell if fully closed over the remaining zone. In this way the discharge of coke from the inclined wharf on to the conveyor belt can be completely interrupted temporarily.

BRIEF DESCRIPTION OF THE DRAWINGS

In the drawings:

FIG. 1 shows diagrammatically a cross-section through a coke wharf, a hollow roll and the conveyor;

FIG. 2 shows the development of the circumferential surface of the hollow roll and FIGS. 3 to 5 show further examples of embodiment for the hollow roll.

DESCRIPTION OF THE PREFERRED EMBODIMENTS

An inclined wharf 10 is supported on columns 11 and has a sloping surface 12 in the form of a grating for receiving the extinguished coke. At the lower free or discharge end 13 there is mounted a hollow roll 14 which extends along the entire length of the inclined wharf 10. The hollow roll 14 has a circumferential shell 15 with a smooth exterior surface, to which there is assigned a correspondingly concave-shaped surface 16 at the discharge end 13 of the inclined wharf 10. The hollow roll 14 has at its free ends bearings and drive means (not shown) which impart rotational drive to the hollow roll 14 in the direction of the arrow 17.

The circumferential shell 15 of the hollow roll 14 has a longitudinally extending peripheral aperture 18 which is essentially of slot-type configuration, i.e. extends over a small portion of the periphery of the chamber 19 located inside the roll 14. Advantageously, the peripheral aperture 18 reaches over an arc of between 10 to 20 percent of the entire periphery of the chamber 19, whilst the remainder of the periphery is formed by the closed circumferential shell 15.

In the position of the hollow roll 14 shown in FIG. 1, coke arrives in the chamber 19 from the surface 12 through the aperture 18. The gap between the surface of the shell 15 and the surface 16 is in this case so chosen that at the prevailing grain size of coke no material can pass through the gap. The coke enters the aperture 18 as soon as the leading edge 20 of the aperture 18 is situated somewhat above the extension of the surface 12. The coke discharge is interrupted as soon as the trailing edge 21 reaches the extension of the surface 12. The smooth closed surface of the circumferential shell 15 adjoining the trailing edge 21 then acts as a retaining wall for the following coke load.

The coke remains in the chamber 19 until the leading edge 20 of the aperture 18 has reached a position above a conveyor belt 22, in which the coke pours out of the chamber 19. The discharge proceeds until all the coke is emptied from the chamber 19 on to the conveyor belt 22. This condition is reached when the trailing edge 21 (see FIG. 1) is located approximately above the right-hand side of the conveyor belt 22. From this position on no coke is delivered on to the conveyor belt 22 so that said belt runs past the inclined wharf 10 until the end of the coke layer reaches the front end of the inclined wharf 10. During this phase the hollow roll 14 continues its rotation so that the filled chamber 19 is again emptied, as soon as an empty stretch of conveyor belt arrives beneath the roll 14.

The conveyor is shown highly schematized as a conveyor belt 22 which in the practical embodiment is provided with a trough for accomodating the coke. Other endless conveyors are also suitable.

Whereas previously a straight peripheral aperture 18 has been described, which runs parallel to the axis of the hollow roll 14, it is particularly advantageous to arrange the peripheral aperture 18 helically, as evident from FIG. 2. Here there is shown a development of the circumferential shell 15 of the hollow roll 14. The helical peripheral aperture 18 extends only over a zone of about 270° of the roll 14, whereas a portion 23 of about 90° is closed. The helical peripheral aperture 18 is so arranged that, taking into consideration the direction of rotation 17, the leading edge 20 at the front free end 24 firstly reaches the extension of the surface 12. The filling of the chamber 19 therefore takes place from the front free end 24 in the direction of the rear free end 25 of the hollow roll 14. If, subsequently, the peripheral aperture 18 has turned through an angle of about 180° in the rotational direction 17, then somewhat more than the front half of the chamber 19 is filled with coke and there commences in the region of the front free end 24 of the roll 14 the discharge on to the conveyor belt 22, which is moving in the direction of the arrow 22', according to FIG. 2. Immediately after discharge, the coke situated on the conveyor belt 22 leaves the zone of the hollow roll 14 and the discharge site shifts from the end 24 towards the end 25, depending on the rotational velocity of the hollow roll 14. Subsequently, there follows the portion 23, in which the discharge of coke is interrupted, and the end of the coke layer is conveyed from the rear end 25 to the front end 24 of the roll 14. The feed rate of the conveyor belt 22 and the rotational velocity of the roll 14 are so co-ordinated with one another that as soon as the end of the coke layer reaches the front end 24, coke is again discharged in the vicinity of the end 24 over the leading edge 20 through the peripheral aperture 18.

The helical arrangement of the peripheral aperture 18 ensures uniform depositing of the coke on the conveyor belt 22. The transferred quantity of coke can be controlled practically infinitely variably, by synchronizing the drives of the roll 14 and of the conveyor belt 22 with one another.

If the hollow roll 14 is brought to a halt when the portion 23 is flush with the surface 12, then no coke can slide down, the chamber 19 is empty and the conveyor belt is likewise unladen.

The hollow roll shown in FIG. 1 has a chamber 19 which corresponds to the entire free interior cavity of the hollow roll 14. If a chamber 19 of such size is not required then, according to FIG. 3, it is possible to provide a false floor 26. The chamber 19 then corresponds to half the volume of the hollow roll 14, whereas a space 27 always remains free. In the case of a helical peripheral aperture 18, the false floor 26 is correspondingly twisted, as indicated in FIG. 3.

If a larger chamber 19 is desired then, according to FIG. 4, a smaller closed space 27 can be formed by false floors 26. Here too, the false floors 26 are twisted in conformity with the path of the helical peripheral aperture 18.

The false floor 26 is advantageously set back in relation to the trailing edge 21 (FIG. 3) in order to prevent coke which is entering the aperture 18 from the surface 12 from penetrating into the gap between the surface of the circumferential shell 15 and the surface 16. However, the false floor 26 causes the coke to be poured immediately rearwards into the chamber 19, so that it could also be advantageous to adjoin the false floor 26 immediately against the trailing edge 21, as shown in FIG. 4. This embodiment represents simultaneously an improved protection for the heavily stressed trailing edge 21, when this latter has to retain the following coke load in conjunction with the circumferential shell 15.

In order to strengthen the hollow roll the circumferential shell 15 can be provided internally with reinforcing rings which, however, do not reduce the free cross-section of the peripheral aperture 18.

The space 27 in the example of embodiment according to FIG. 3 may also be provided as a chamber 19 with a peripheral aperture 18. The two symmetrically arranged chambers 29 then each have one peripheral aperture 18 which extends over 10 to 20 percent of an arc of 180°. It is also possible for two completely closed portions 23 to be provided, which for example then extend through 45°. Such an arrangement can be used when exclusively small grain sizes occur.

Finally, according to FIG. 5, another aperture 18' can be provided diametrically opposite the aperture 18, so that a portion of the coke entering the chamber 19 at 18 immediately leaves again at 18'. The remaining amount of coke then left in the chamber 19 is discharged upon further rotation of the hollow roll 14 so that uniform depositing on the conveyor belt 22 is also achieved in transverse direction. The arrangements in the chamber 19 correspond approximately to those according to FIG. 4.

It is, of course, to be understood that the present invention is, by not means, limited to the specific showing in the drawings, but also comprises any modifications within the scope of the appended claims.

What is claimed is:

1. In an apparatus for uniformly and controllably removing coke delivered continuously from an inclined wharf without any retaining grate and in combination with a horizontal endless conveyor belt arranged below and extending longitudinally of the lower discharge end of said wharf which has a concave-shaped end surface, a rotatably mounted and continuously driven roll openly disposed at said discharge end of said wharf for uniformly transferring the coke in measured quantities on to said horizontal conveyor, said roll being provided with a circumferential shell enclosing a chamber within the cavity of said hollow roll, said concave-shaped end surface forming a gap with the respective opposite-adjacent surface portion of said circumferential shell, said chamber having a peripheral aperture provided in said circumferential shell, said peripheral aperture extending helically over the periphery and extending longitudinally over the entire length of said roll but only over a small portion of the periphery of said chamber.

2. An apparatus in combination according to claim 1 wherein said peripheral aperture extends over an arc of 10 to 20 percent of the entire periphery of said chamber.

3. An apparatus in combination according to claim 1 wherein said entire cavity of said roll takes the form of a unitary chamber having said peripheral aperture extending over an arc of 10 to 20 percent of the entire periphery of said chamber.

4. An apparatus in combination according to claim 1 wherein only a part of said cavity of said roll takes the form of a chamber having said peripheral aperture extending over an arc of 10 to 20 percent of the entire periphery of said chamber.

5. An apparatus for uniformly and controllably removing coke delivered continuously from an inclined wharf without any retaining grate and in combination with a horizontal endless conveyor belt arranged below and extending longitudinally of the lower discharge end of said wharf comprising: a concave-shaped end surface at the lower discharge end of said wharf, a rotatably mounted and continuously driven roll disposed at said discharge end of said wharf for transferring the coke in measured quantities on to said horizontal conveyor, said roll being provided with a circumferential shell enclosing a chamber within the cavity of said hollow roll, said concave-shaped end surface forming a gap with the respective opposite-adjacent surface portion of said circumferential shell, said chamber having a peripheral aperture provided in said circumferential shell and extending longitudinally over the entire length of said roll, said peripheral aperture extending helically only over a zone of about 270° of the entire periphery of said hollow roll, wherein a zone of about 90° of the entire periphery of said hollow roll is provided with a closed smooth surface of said shell which closed surface zone extends over the entire length of said hollow roll.

6. An apparatus in combination according to claim 5 wherein said cavity of said hollow roll is provided with a false floor extending over the entire length of said hollow roll.

7. An apparatus in combination according to claim 6 wherein said false floor is twisted.

* * * * *